United States Patent [19]

Johnson

[11] 4,104,568

[45] Aug. 1, 1978

[54] SCAN-CONVERTER TUBE SYSTEM

[75] Inventor: Charles Bruce Johnson, Fort Wayne, Ind.

[73] Assignee: International Telephone & Telegraph Corporation, Nutley, N.J.

[21] Appl. No.: 726,894

[22] Filed: Sep. 27, 1976

[51] Int. Cl.[2] ..... H01J 29/70; H01J 29/72

[52] U.S. Cl. ..... 315/394; 315/8.5; 358/140; 328/124; 365/118

[58] Field of Search ..... 315/13 ST, 8.5, 409, 315/394; 313/391, 392, 394, 321, 326, 327; 340/173 CR; 358/140, 11; 357/24, 29; 328/123, 124, 126; 307/221 D

[56] References Cited

U.S. PATENT DOCUMENTS

| | | | |
|---|---|---|---|
| 3,333,146 | 7/1967 | Dill, Jr. et al. | 315/372 |
| 3,376,464 | 4/1968 | Loty et al. | 313/421 |
| 3,641,510 | 2/1972 | Chen | 340/173 CR |
| 3,774,168 | 11/1973 | Koo et al. | 340/173 CR |

*Primary Examiner*—Maynard R. Wilbur
*Assistant Examiner*—T. M. Blum
*Attorney, Agent, or Firm*—John T. O'Halloran; Alfred C. Hill

[57] ABSTRACT

A write electron gun is disposed at one end of a vacuum envelope to produce an electron beam modulated by an external input signal having signal elements occurring at a first given rate. A self-scanned array is disposed at the other end of the envelope. An electron beam deflection system is disposed in the envelope between the electron gun and the array to scan the electron beam over the array to store the signal elements in the array with the array providing electron gain for the stored signal elements. A source of read out signals is disposed externally of the envelope coupled to the array to read out the signal elements at a second given rate less than the first given rate.

15 Claims, 1 Drawing Figure

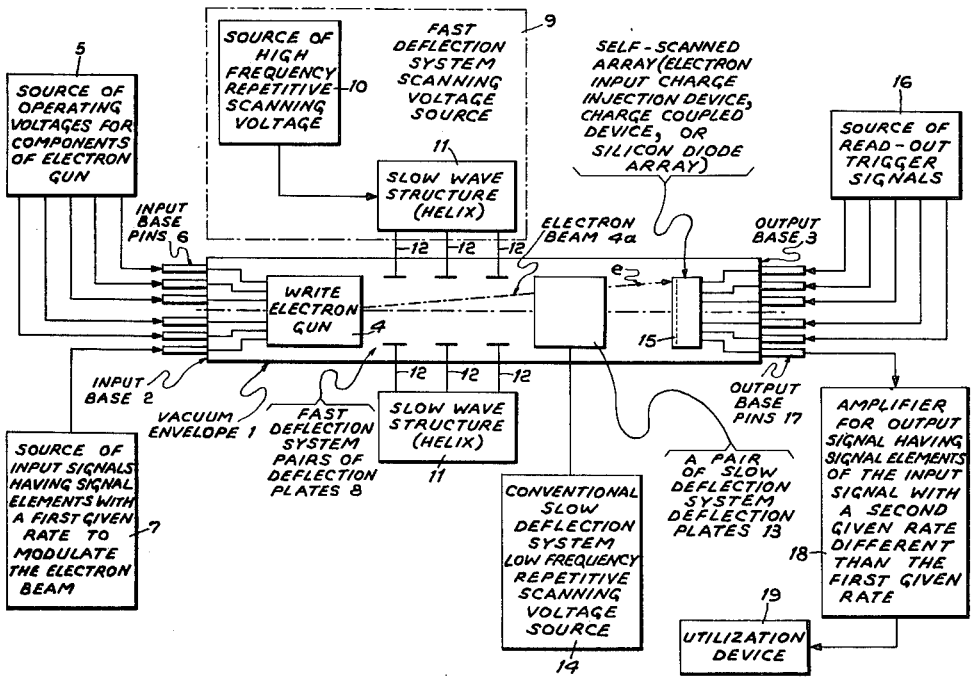

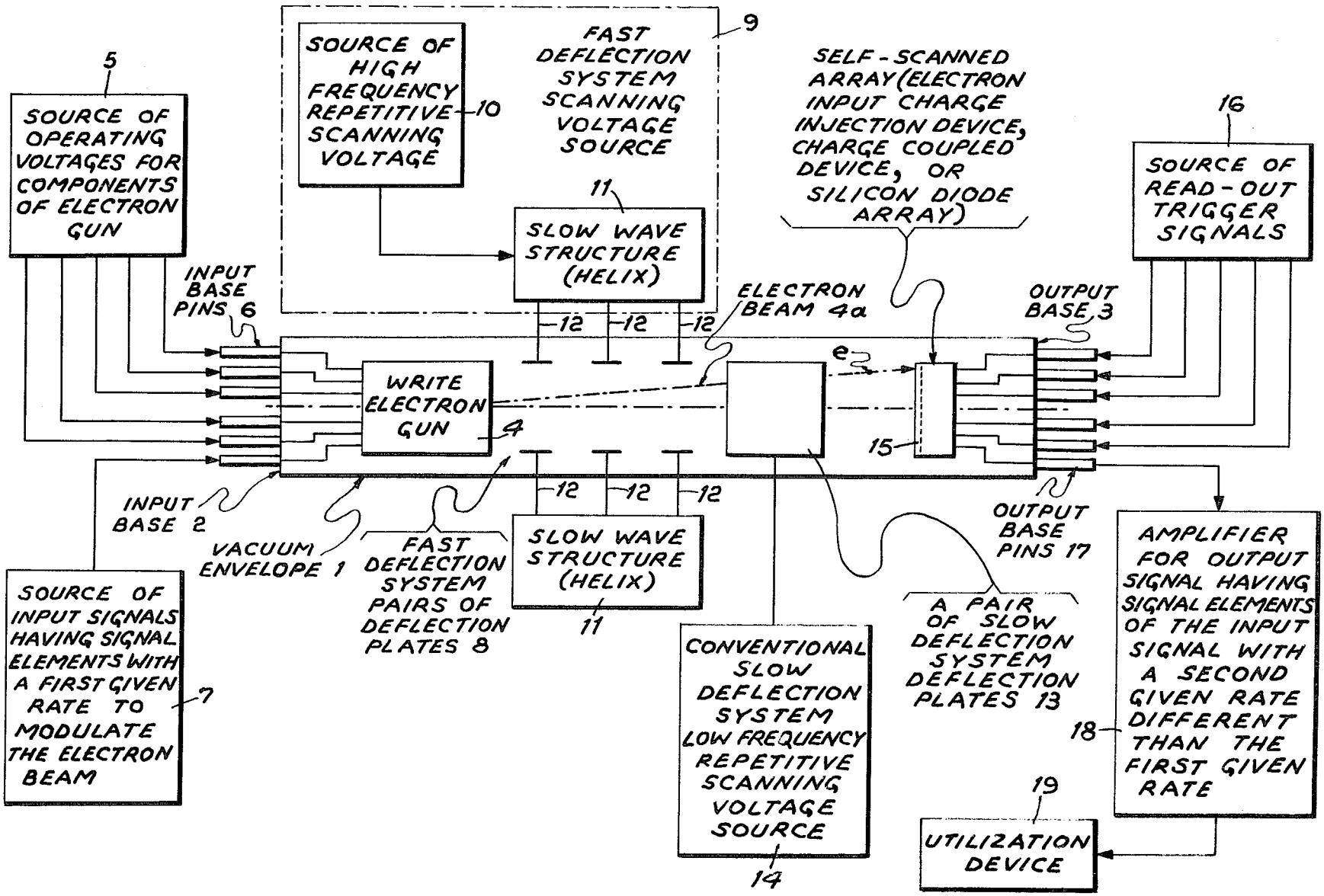
SOURCE OF READ-OUT TRIGGER SIGNALS
16
AMPLIFIER FOR OUTPUT SIGNAL HAVING SIGNAL ELEMENTS OF THE INPUT SIGNAL WITH A SECOND GIVEN RATE DIFFERENT THAN THE FIRST GIVEN RATE
18
UTILIZATION DEVICE
19
OUTPUT BASE 3
OUTPUT BASE PINS 17
SELF-SCANNED ARRAY (ELECTRON INPUT CHARGE INJECTION DEVICE, CHARGE COUPLED DEVICE, OR SILICON DIODE ARRAY)
A PAIR OF SLOW DEFLECTION SYSTEM DEFLECTION PLATES 13
15
ELECTRON BEAM 4a
e
CONVENTIONAL SLOW DEFLECTION SYSTEM LOW FREQUENCY REPETITIVE SCANNING VOLTAGE SOURCE
14
9
FAST DEFLECTION SYSTEM SCANNING VOLTAGE SOURCE
SLOW WAVE STRUCTURE (HELIX)
11
12
SLOW WAVE STRUCTURE (HELIX)
11
SOURCE OF HIGH FREQUENCY REPETITIVE SCANNING VOLTAGE
10
WRITE ELECTRON GUN
4
FAST DEFLECTION SYSTEM PAIRS OF DEFLECTION PLATES 8
VACUUM ENVELOPE 1
INPUT BASE PINS 6
INPUT BASE 2
SOURCE OF OPERATING VOLTAGES FOR COMPONENTS OF ELECTRON GUN
5
SOURCE OF INPUT SIGNALS HAVING SIGNAL ELEMENTS WITH A FIRST GIVEN RATE TO MODULATE THE ELECTRON BEAM
7

SCAN-CONVERTER TUBE SYSTEM

BACKGROUND OF THE INVENTION

This invention relates to converter tube systems and more particularly to scan-converter tube systems.

Presently available scan-converter tubes employ a two-electron gun arrangement, one of said electron guns being employed for writing onto a tube storage component and the other electron gun for reading out the information stored on the storage component. The disadvantage of such an arrangement is that the electron beam read out assembly is bulky and complex.

SUMMARY OF THE INVENTION

The object of the present invention is to provide an improved scan-converter tube system which is not bulky and complex.

Another object of the present invention is to provide a scan converter tube system employing an electron input self-scanned array in place of the prior art bulky and complex electron beam read out assembly.

A further object of the present invention is to provide a scan-converter tube system which employs an electron input self-scanned array which produces storage and read out gain required for high speed (nano to pico second) applications.

A feature of the present invention is the provision of a scan-converter tube system comprising: a write electron gun disposed at one end of a vacuum envelope to produce an electron beam modulated by an external input signal having signal elements occurring at a first given rate; a self-scanned array disposed at the other end of the envelope; an electron beam deflection system disposed in the envelope between the electron gun and the array to scan the electron beam over the array to store the signal elements in the array, the array providing amplification of the stored signal elements; and a source of read out signals disposed externally of the envelope coupled to the array to read out the signal elements at a second given rate different than the first given rate.

BRIEF DESCRIPTION OF THE DRAWING

Above-mentioned and other features and objects of this invention will become more apparent by reference to the following description taken in conjunction with the accompanying drawing, in which the single FIGURE is a diagrammatic illustration of the scan-converter tube system in accordance with the principles of the present invention.

DESCRIPTION OF THE PREFERRED EMBODIMENT

The description of the FIGURE of the drawing is directed to a scan-converter tube system to convert fast input rate signal elements to slow read out signal elements. However, the principles of the tube system of the present invention could also be used to convert slow input rate signal elements to fast rate output signal elements.

Referring to the FIGURE, the scan-converter tube system of the present invention includes a scan-converter tube having a vacuum envelope 1 with an input base 2 and an output base 3. Internally of the envelope 1 there is disposed a write electron gun 4 receiving its operating voltages for the components thereof from source 5 through certain of the input base pins 6 which are an integral part of input base 2. One of the input pins 6 is coupled to source 7 which provides an external input signal having signal elements with a fast rate to modulate the electron beam **4*a* formed by electron gun 4. The modulated electron beam 4*a* emitted from electron gun 4 passes through a fast deflection system including a plurality of pairs of deflection plates 8 which receive a repetitive scanning voltage from the fast deflection system scanning voltage source 9. Scanning voltage source 9 includes a source 10 of high frequency repetitive scanning voltage which is coupled to a slow wave structure 11, such as a helix, which has a plurality of taps 12 spaced therealong. Each of the taps 12 are coupled to a different one of the pair of deflection plates 8 with the spacing of taps 12 with respect to each other being such that each full cycle of the high frequency scanning voltage is coupled to each of the pairs of deflection plates 8 in sequence. After emerging from the fast deflection system, electron beam 4*a* is deflected by a slow deflection system which includes a pair of slow deflection system deflection plates 13 which are physically orthogonally related to the orientation of the fast pairs of deflection plates 8. A source 14 which provides a conventional slow deflection system low frequency repetitive scanning voltage is coupled to deflection plates 13. After being deflected by the slow deflection system the electron beam 4*a* impinges upon a self-scanned array 15. Array 15 may be an electron input charge injection device (CID) obtainable from General Electric and other manufacturers of CID's, array 15 may be a charge coupled device (CCD) obtainable from RCA, Fairchild, Texas Instruments and other manufacturers of CCD's, or array 15** may be an electron bombardment input silicon diode array such as available from Reticon Corporation.

The fast deflection system operates to scan electron beam **4*a* along lines of array 15 while the slow deflection system moves the electron beam 4*a* sequentially to successive lines of the array to cause storage of the signal elements from source 7 in array 15. The signal elements will be stored in array 15 until such time as a read out is desired. When a read out is desired, source 16 provides read out trigger signals which are coupled to certain of the output base pins 17 which are an integral part of output base 3 with the trigger signals of source 16 triggering the array 15 to provide the signal on one of the output base pins 17 for coupling to an amplifier 18. The output signal coupled to amplifier 18 includes the signal elements of the input signal of source 7 with a second given rate which is less than the first given rate thereby providing the desired scan conversion. After the output signal is amplified in amplifier 18, it is coupled to some desired utilization device 19**.

The array 15 performs the function of storage of the signal elements of the input signal from source 7 and provides electron gain or amplification therein for the stored signal elements. Thus, the scan-converter tube system of the present invention provides an arrangement for fast writing into array 15, storage of the input signal elements in array 15, electron gain or amplification of the signal elements stored in array 15 and a read out at a slow rate when desired.

A modification of the scan-converter tube system just described could employ two fast deflection systems similar to the one illustrated in the FIGURE. Such a modification would provide circular or spiral writing of the signal elements into array 15.

While I have described above the principles of my invention in connection with specific apparatus it is to be clearly understood that this description is made only by way of example and not as a limitation to the scope of my invention as set forth in the objects thereof and in the accompanying claims.

I claim:

1. A scan-converter tube system comprising:
a write electron gun disposed at one end of a vacuum envelope to produce an electron beam modulated by an external input signal having signal elements occurring at a first given rate;
a self-scanned matrix array disposed at the other end of said envelope;
an electron beam deflection system disposed in said envelope between said electron gun and said array to scan said electron beam over said array to store said signal elements in said array, said array providing amplification of said stored signal elements;
said deflection system including
a fast deflection system disposed along said electron beam to scan said electron beam along lines of said array, and
a slow deflection system disposed along said electron beam spaced from said fast deflection system to move said electron beam sequentially to successive lines of said array, and
a source of read out signals disposed externally of said envelope, said read out signals being coupled as inputs to said array to read out said signal elements at a second given rate different than said first given rate.

2. A tube system according to claim 1, wherein said second given rate is less than said first given rate.

3. A tube system according to claim 2, wherein said array includes
an electron input charge injection device.

4. A tube system according to claim 2, wherein said array includes
an electron input charge coupled device.

5. A tube system according to claim 4, wherein said deflection system includes
a fast deflection system to scan said electron beam along lines of said array, and
a slow deflection system to move said electron beam sequentially to successive lines of said array.

6. A tube system according to claim 5, wherein said fast deflection system includes
a plurality of pairs of fast deflection plates disposed within said envelope adjacent said electron gun in spaced relation with respect to each other along a longitudinal axis of said envelope, said plurality of fast deflection plates having a given orientation with respect to said electron beam;
a slow wave structure disposed externally of said envelope having a plurality of taps spaced therealong, each of said plurality of taps being coupled to a different one of said plurality of pairs of fast deflection plates, and
a source of high frequency repetitive scanning voltage coupled to said slow wave structure,
said plurality of taps being spaced with respect to each other so that each full cycle of said high frequency scanning voltage is coupled to each of said plurality of fast deflection plates in sequence; and
said slow deflection system includes
a pair of slow deflection plates disposed in said envelope adjacent the last of said plurality of fast deflection plates having an orientation orthogonally related to said given orientation, and
a source of low frequency repetitive scanning voltage coupled to said pair of slow deflection plates.

7. A tube system according to claim 6, wherein said slow wave structure is a helix.

8. A tube system according to claim 1, wherein said fast deflection system includes
a plurality of pairs of fast deflection plates disposed within said envelope adjacent said electron gun in spaced relation with respect to each other along a longitudinal axis of said envelope, said plurality of fast deflection plates having a given orientation with respect to said electron beam;
a slow wave structure disposed externally of said envelope having a plurality of taps spaced therealong, each of said plurality of taps being coupled to a different one of said plurality of pairs of fast deflection plates, and
a source of high frequency repetitive scanning voltage coupled to said slow wave structure,
said plurality of taps being spaced with respect to each other so that each full cycle of said high frequency scanning voltage is coupled to each of said plurality of fast deflection plates in sequence; and
said slow deflection system includes
a pair of slow deflection plates disposed in said envelope adjacent the last of said plurality of fast deflection plates having an orientation orthogonally related to said given orientation, and
a source of low frequency repetitive scanning voltage coupled to said pair of slow deflection plates.

9. A tube system according to claim 8, wherein said slow wave structure is a helix.

10. A tube system according to claim 1, wherein said array includes
an electron input charge injection device.

11. A tube system according to claim 10, wherein said fast deflection system includes
a plurality of pairs of fast deflection plates disposed within said envelope adjacent said electron gun in spaced relation with respect to each other along a longitudinal axis of said envelope, said plurality of fast deflection plates having a given orientation with respect to said electron beam;
a slow wave structure disposed externally of said envelope having a plurality of taps spaced therealong, each of said plurality of taps being coupled to a different one of said plurality of pairs of fast deflection plates, and
a source of high frequency repetitive scanning voltage coupled to said slow wave structure,
said plurality of taps being spaced with respect to each other so that each full cycle of said high frequency scanning voltage is coupled to each of said plurality of fast deflection plates in sequence; and
said slow deflection system includes
a pair of slow deflection plates disposed in said envelope adjacent the last of said plurality of fast deflection plates having an orientation orthogonally related to said given orientation, and
a source of low frequency repetitive scanning voltage coupled to said pair of slow deflection plates.

12. A tube system according to claim 11, wherein said slow wave structure is a helix.

13. A tube system according to claim 1, wherein said array includes an electron input charge coupled device.

14. A tube system according to claim 13, wherein said fast deflection system includes a plurality of pairs of fast deflection plates disposed within said envelope adjacent said electron gun in spaced relation with respect to each other along a longitudinal axis of said envelope, said plurality of fast deflection plates having a given orientation with respect to said electron beam;

a slow wave structure disposed externally of said envelope having a plurality of taps spaced therealong, each of said plurality of taps being coupled to a different one of said plurality of pairs of fast deflection plates, and a source of high frequency repetitive scanning voltage coupled to said slow wave structure, said plurality of taps being spaced with respect to each other so that each full cycle of said high frequency scanning voltage is coupled to each of said plurality of fast deflection plates in sequence; and said slow deflection system includes a pair of slow deflection plates disposed in said envelope adjacent the last of said plurality of fast deflection plates having an orientation orthogonally related to said given orientation, and a source of low frequency repetitive scanning voltage coupled to said pair of slow deflection plates.

15. A tube system according to claim 14, wherein said slow wave structure is a helix.

* * * * *